US008367203B2

(12) United States Patent
Rüf et al.

(10) Patent No.: US 8,367,203 B2
(45) Date of Patent: Feb. 5, 2013

(54) CELLULOSIC MOLDED BODY, METHOD FOR MANUFACTURING IT AND USE THEREOF

(75) Inventors: Harmut Rüf, Schörfling (AT); Heinrich Firgo, Vöcklabruck (AT); Gert Kroner, Lenzing (AT)

(73) Assignee: Lenzing Aktiengesellschaft, Lenzing (AT)

( * ) Notice: Subject to any disclaimer, the term of this patent is extended or adjusted under 35 U.S.C. 154(b) by 814 days.

(21) Appl. No.: 12/064,770

(22) PCT Filed: Aug. 17, 2006

(86) PCT No.: PCT/AT2006/000342

§ 371 (c)(1),
(2), (4) Date: Feb. 25, 2008

(87) PCT Pub. No.: WO2007/022552

PCT Pub. Date: Mar. 1, 2007

(65) Prior Publication Data

US 2008/0233821 A1 Sep. 25, 2008

(30) Foreign Application Priority Data

Aug. 26, 2005 (AT) ..... A 1407/2005
Dec. 19, 2005 (AT) ..... A 2028/2005

(51) Int. Cl.
*D02G 3/00* (2006.01)
*C08L 1/00* (2006.01)
*B27N 3/04* (2006.01)

(52) U.S. Cl. ..... 428/364; 977/778; 106/162.1; 106/200.1; 264/239; 264/240

(58) Field of Classification Search ..... 977/778; 428/364; 106/162.1, 200.1; 264/239, 240
See application file for complete search history.

(56) References Cited

U.S. PATENT DOCUMENTS

| | | | | |
|---|---|---|---|---|
| 4,246,221 | A | 1/1981 | McCorsley, III | 264/203 |
| 6,893,492 | B2 | 5/2005 | White et al. | 106/164.51 |
| 2003/0228454 | A1 * | 12/2003 | Barlow et al. | 428/297.4 |
| 2004/0033352 | A1 * | 2/2004 | Massa et al. | 428/323 |
| 2005/0051054 | A1 * | 3/2005 | White et al. | 106/164.3 |
| 2005/0095263 | A1 * | 5/2005 | Asotra et al. | 424/400 |

FOREIGN PATENT DOCUMENTS

| | | |
|---|---|---|
| DE | 44 26 966 C2 | 2/1996 |
| JP | 2002-346509 | 12/2002 |
| WO | WO 93/12173 | 6/1993 |
| WO | WO 94/21724 | 9/1994 |

(Continued)

OTHER PUBLICATIONS

PCT International Preliminary Report on Patentability (Form PCT/IB/373); PCT Written Opinion of the Searching Authority (Form PCT/ISA/237).

(Continued)

*Primary Examiner* — Matthew Matzek
(74) *Attorney, Agent, or Firm* — Fitzpatrick, Cella, Harper & Scinto

(57) ABSTRACT

The present invention relates to a cellulosic molded body containing a cellulose/clay nanocomposite, wherein the clay component of said nanocomposite comprises a material selected from the group consisting of unmodified hectorite clays and hydrophilically modified hectorite clays.

36 Claims, 1 Drawing Sheet

FOREIGN PATENT DOCUMENTS

Figure 1:
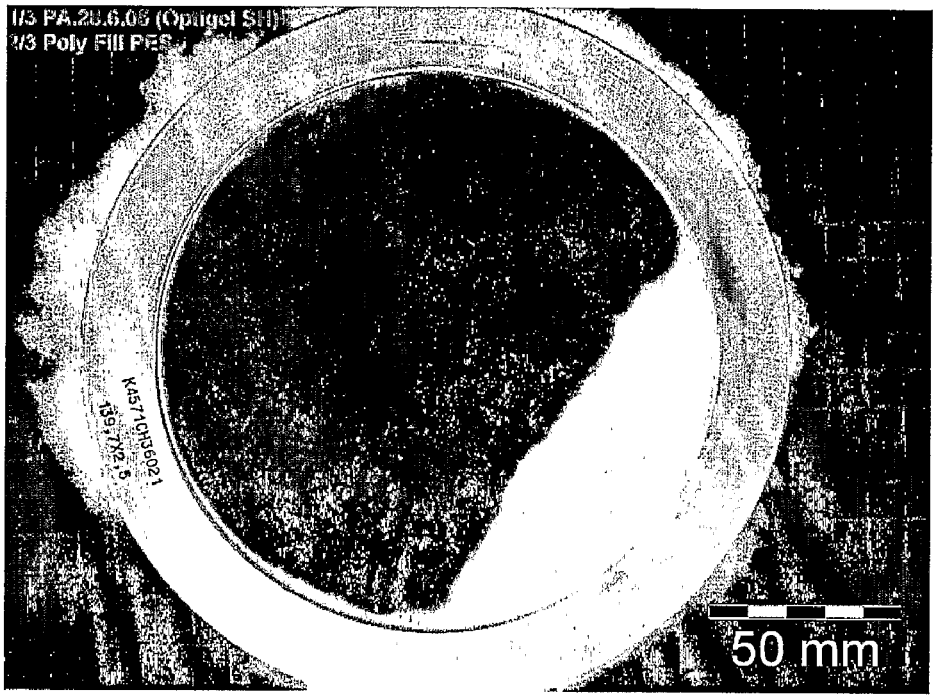

| | | | |
|---|---|---|---|
| WO | WO 94/26962 | | 11/1994 |
| WO | WO 96/05356 | | 2/1996 |
| WO | WO 96/27638 | | 9/1996 |
| WO | WO 97/02315 | | 1/1997 |
| WO | WO 00/53833 | | 9/2000 |
| WO | WO 03/024890 | A2 | 3/2003 |
| WO | WO 03/024891 | A2 | 3/2003 |
| WO | WO 2004/081267 | A1 | 9/2004 |
| WO | WO 2005/026429 | A2 | 3/2005 |

OTHER PUBLICATIONS

Vorbach et al., "Herstellung kerainischer Hohlmembranen und -filamente nach dem Lyocell-Verfahren", Keramische Zeitschrift 50 (3) 1998, pp. 176-179.

Vorbach et al., "Keramische Hohlmembranen, Filamente und Strukturwerkstoffe auf Basis des Alceru-Verfahrens", Technische Textilien (41), 1998, pp. 188-193.

White et al., "Cellulose-Based Nanocomposites: Fiber Production and Characterization", Polymeric Materials: Science and Engineering 2004, vol. 90, pp. 40 and 50.

Delhom et al., "Laboratory Scale and Nonwovens Production of Cellulose-Clay Nanocomposites", Polymeric Materials: Science and Engineering 2004, vol. 91, pp. 532 and 533.

L.K. Golova et al., "Biodegradable Film Nanocomposites Based on Cellulose and Starch", Publisher: Izdatel'stvo "Posad" , Vladimir, Russian Federation, May 5-8, 2003, pp. 287-290.

Okamoto, "Polymer/Clay of Nanocomposites", Encyclopedia of Nanoscience and Nanotechnology®, vol. 8, pp. 791-843, 2004.

X. Liu et al., "Cellulose Nanocomposites" 2nd International Conference on Eco-Composites, Sep. 1-2, 2003, Queen Mary, University of London, UK.

White et al., "Preparation of Cotton/Clay Nanocomposites", Polymer Preprints 2002, vol. 43(2), 1279-1280.

White et al., "Preparation and Thermal Analysis of Cotton-Clay Nanocomposites", J. Appl. Polym. Sci., vol. 92, pp. 2125-2131, May 15, 2004.

International Search Report dated Oct. 18, 2006, regarding International Appln. No. PCT/AT2006/000342.

* cited by examiner

CELLULOSIC MOLDED BODY, METHOD FOR MANUFACTURING IT AND USE THEREOF

The present invention relates to a cellulosic moulded body, a method for manufacturing it and uses thereof.

Especially, the present invention relates to Lyocell fibres having improved flame-retardant properties.

Lyocell fibres are cellulosic fibres produced by the so-called "amine-oxide" or "Lyocell process". In this process, the cellulose is dissolved directly in an aqueous tertiary amine-oxide without the formation of a derivative, and the solution is spun. Such fibres are also referred to as "solvent spun" fibres. "Lyocell" is the generic name allocated by BISFA (The International Bureau for the Standardization of Man made Fibers) for cellulose fibres which are produced by dissolving cellulose in an organic solvent without the formation of a derivative and extruding fibres from said solution by means of a dry-wet spinning process or a melt-blown process. An organic solvent is thereby understood to be a mixture of an organic chemical and water. At present, N-methyl-morpholine-N-oxide (NMMO) is used as an organic solvent on a commercial scale.

In said process, the solution of the cellulose is usually extruded by means of a forming tool, whereby it is moulded. Via an air gap, the moulded solution enters a precipitation bath, where the moulded body is obtained by precipitating the solution. The moulded body is washed and optionally dried after further treatment steps. A process for the production of Lyocell fibres is described, for instance, in U.S. Pat. No. 4,246,221. Lyocell fibres are distinguished by a high tensile strength, a high wet-modulus and a high loop strength.

The Lyocell process can also be used for producing other moulded bodies, such as films, sheets or membranes, or for producing sponges.

There have been many attempts in the prior art to modify cellulose moulded bodies, such as fibres, in order to impart thereon flame-retardant properties.

As regards moulded bodies produced according to the amine-oxide process, such as Lyocell fibres, WO 93/12173 discloses triazine compounds containing phosphorus and their use, including use in cellulose solutions in tertiary amine oxides.

WO 94/21724 describes flame retardants containing phosphorus. The use thereof for Lyocell fibres is also mentioned.

WO 94/26962 discloses a process for the manufacture of a flame retardant Lyocell fibre. In this process, a flame retardant is added during the manufacturing process of the fibres, before drying of the fibres.

According to WO 96/05356, textile materials containing Lyocell fibres are treated with compounds containing phosphorus and nitrogen.

WO 97/02315 discloses the manufacture of a flame-retardant Lyocell fibre, whereby a cyclic phosphine-oxide is added to the spinning dope.

DE 44 26 966 generally mentions the addition of filling compounds to Lyocell fibres, whereby the filling compounds are added in high amounts.

WO 96/27638 quite generally mentions silicates as flame retardant agents, which can be added to a Lyocell dope.

WO 04/081267 discloses modified fibres, which have been produced according to the amine-oxide process and to which ceramic oxides, preferably silicon dioxide, are added.

Vorbach et al., in two publications titled "Herstellung keramischer Hohlmembranen und-filamente nach dem Lyocell-Verfahren" in Keramische Zeitschrift 50 (3) 1998, pp. 176-179 and "Keramische Hohlmembranen, Filamente und Strukturwerkstoff auf Basis des Alceru-Verfahrens" in Technische Textilien (41), 1998, pp. 188-193, mention pore forming materials which can be added to cellulosic moulded bodies, including alumosilicates. According to the process disclosed, cellulose only serves as a carrier polymer, which is subsequently burned out in order to form a ceramic moulded body.

WO 03/24890 and WO 03/24891, respectively, disclose the addition of alumosilicates to amine-oxide-cellulose spinning dopes for the manufacture of ceramic fibres.

WO 00/53833 discloses the use of alumosilicates in a process for the manufacture of bicomponent fibres. Again, the purpose of the process disclosed in this document is to produce ceramic moulded bodies.

The above processes have several disadvantages: Some of the known processes are expensive or use substances which are questionable from an ecological viewpoint. Many of the processes published up to now are not compatible with the requirements of a continuous fibre production process. For this reason, up to now none of the above proposals has reached the stage of production in large scale.

Therefore, there is a desire for a flame-retardant cellulosic moulded body, especially a fibre, which can be manufactured in an economical way, there being no physiological or ecological concerns regarding the flame retardant agent employed, and where no difficulties when transferring the production process to large-scale production are to be expected.

This object is achieved by a cellulosic moulded body containing a cellulose/clay nanocomposite, said moulded body being characterized in that the clay component of said nanocomposite comprises a material selected from the group consisting of unmodified hectorite clays and hydrophilically modified hectorite clays.

In the moulded body of the invention, the cellulose/clay nanocomposite is not only present on the surface of the cellulosic body, but is also dispersed throughout the cellulosic matrix of the moulded body. This is achieved by incorporating the hectorite clay material in the cellulosic moulded body. The skilled artisan is aware of the possibilities to incorporate materials into cellulosic moulded bodies, such as adding the materials to a solution of cellulose before moulding, or to a precursor of said solution, such as a suspension of cellulose in a cellulose solvent.

Under "unmodified clay", a clay which has not been chemically pretreated is to be understood.

Under "hydrophilically modified clay", a clay which has been pretreated with agents imparting hydrophilic properties to the clay or enforcing the existing hydrophilic properties of the clay, respectively, is to be understood.

It is known to produce so-called "nanocomposites" of clays and polymers, wherein the clay is intimately mixed with the polymer matrix. In order to produce such nanocomposites, it is often necessary to pretreat the clay material with hydrophobic organic cations, such as alkylammonium cations. By such pretreatment, the layers of $SiO_4$-tetrahedrons making up the clay are exfoliated, and the hydrophobic properties imparted on the clay layers render the clay compatible with various polymers.

Okamoto M. provides a good overview over the technology of Polymer/clay nanocomposites in a review in "Encyclopedia of Nanoscience and Nanotechnology", Ed. H. S, Nalwa, Volume 8, pp 791-843, American Scientific Publishers 2004.

Nanocomposites of clays and polymers are known to have improved flame-retardant properties, such as an increased degradation temperature and enhanced char yields.

X. Liu et al., in a talk named "Cellulose/Clay Nanocomposites" held at the 2nd International Conference on Eco-Composites, 1-2 Sep. 2003, Queen Mary, University of London, UK, describe addition of a montmorrilonite clay (Cloisite 30B of Messr. Southern Clay), which is a clay modified with organic cations (methyl-tallow-bis(2-hydroxyethyl) ammoniumchloride-montmorillonite), to a cellulose solution in NMMO. The solution is cast into a film, which is then coagulated by dipping into water.

In several publications, ("Preparation of Cotton/Clay Nanocomposites", Polymer Preprints 2002, Vol 43(2), 1279-1280; "Preparation and Thermal Analysis of Cotton-Clay Nanocomposites", J. Appl. Polym. Sci., Vol. 92, 2125-2131 (2004); "Cellulose-Based Nanocomposites: "Fiber Production and Characterization" Polymeric Materials: Science and Engineering 2004, Vol. 90, 40-50; "Laboratory Scale and Nonwovens Production of Cellulose/Clay Nanocomposites", Polymeric Materials: Science and Engineering 2004, Vol. 91, 532-533; U.S. Pat. No. 6,893,492 B2 and WO 2005/026429 A2), White et al. describe the production of nanocomposites of cellulose comprising up to 15% montomorillonite.

According to these publications, montmorillonite, which has been pretreated with organic cations, is dispersed in 50% NMMO. Cellulose material is added to this dispersion, and a solution is produced. It is described that the solution is extruded via an automated syringe pump to form fibres. According to these publications, pretreatment of the montmorillonite clay with an alkylammonium cation such as a dodecyl-ammonium salt is mandatory.

JP-A 2002-346509 discloses shaped bodies containing cellulose and, inter alia, montmorillonite by mixing montmorillonite into viscose and regenerating the cellulose with sulphuric acid. A shaped body containing 25%-75% of inorganic fillers/clay is claimed for use as a cellulose support for garbage disposal.

In the conference lecture "Biodegradable film nanocomposites based on cellulose and starch" held by Golova, L. K.; Kuznetsova, L. K.; Korolev, Yu. M.; Kulichikhin, V. G. (published in: Editor: Bondar, V. A. Efiry Tsellyulozy i IKrakhmala: Sintez, Svoistva, Primenenie, Materialy Yubileinoi Vserossiiskoi Nauchno-Tekhnicheskoi Konferntsii s Mezhdunarodnym Uchastiem, 10th, Suzdal. Russian Federation, May 5-8, 2003, 287-290 Publisher: Izdatel'stvo "Posad", Vladimir, Russia), the mixing of montmorillonite either in the sodium form or in the form of hydrophobically modified montmorillonite (Cloisite 20 A, producer Southern Clay, which is a montmorillonite modified with dimethyl-dihydrogenated tallow quaternary ammonium chloride) to a cellulose-NMMO-solution is disclosed.

It has now been surprisingly found that it is possible to produce a cellulosic moulded body, such as a fiber, with improved flame-retardant properties, by forming a cellulose/clay nanocomposite in the moulded body, which nanocomposite comprises an unmodified hectorite clay (i.e. a hectorite clay which has not been chemically pretreated at all) or a hectorite clay which is hydrophilically modified (i.e. a hectorite clay which has been pretreated with hydrophilic agents, such as e.g. a glucosammonium salt, contrary to treatment with hydrophobic cations such as the alkylammonium salts mentioned above).

Especially, it has been found that hectorite, a clay of the smectite group, not only can be successfully incorporated into a cellulosic moulded body without any chemical pretreatment, thereby forming a cellulose/hectorite nanocomposite, but also confers to said moulded body improved flame-retardant properties which are superior to those of cellulosic moulded bodies incorporating pretreated montmorillonite clay.

In the present invention, synthetic hectorite types are preferred over naturally occurring hectorite types.

Preferably, the portion of the clay component in the moulded body according to the invention ranges from 5 to 40% by weight of the moulded body.

In a further preferred embodiment, the moulded body has been produced from a solution of cellulose in an aqueous tertiary amine-oxide. This means, the cellulosic moulded body has been produced by the Lyocell process. The tertiary amine-oxide preferably is NMMO.

The moulded body may be present in the form of a filament fibre, a staple fibre, a film or a membrane.

An especially preferred embodiment of the present invention is a Lyocell staple fibre, containing a cellulose/clay nanocomposite with unmodified hectorite clay as the clay component.

Moulded bodies in the form of fibres may be further processed to yarns, woven products such as fabrics, knits, and nonwoven products.

A process for the manufacturing of the cellulose moulded body of the present invention, using the Lyocell process, comprises the subsequent steps of a) providing cellulose b) preparing a mixture of said cellulose with an aqueous tertiary amine-oxide c) converting said mixture into a solution of cellulose in the aqueous tertiary amine-oxide d) moulding said solution via a moulding tool e) precipitating said solution in a precipitating fluid, and is characterized in that at least one of steps a) to c) is carried out in the presence of a material selected from the group consisting of unmodified hectorite clays and hydrophilically modified hectorite clays.

In the process according to the invention, the clay material may for example be added to

- a cellulose pulp as the starting material of step a)
- during preparing the suspension of cellulose in NMMO or to the already prepared suspension (step b) or
- during dissolving the cellulose or to the solution of cellulose in NMMO (step c).

It is well-known to the skilled artisan how to add a material in one of steps a) to c).

A preferred embodiment of the process according to the invention is characterized in that in step b) a first suspension of the clay in the aqueous tertiary amine-oxide is prepared, and that the cellulose is added to said suspension in order to form a second suspension, which can then be further processed to a solution.

NMMO is preferably used as the aqueous tertiary amine-oxide.

When dispersing the clay in the aqueous tertiary amine-oxide, preferably high shear forces are applied to the clay. This can be accomplished for example by preparing the dispersion in an Ultra-Turrax® mixer.

The portion of the clay in said dispersion is preferably from 1 to 4% by weight of dispersion.

An especially preferred embodiment of the process according to the invention comprises dispersing unmodified hectorite clay in an aqueous NMMO containing 60 to 84% by weight NMMO by means of an Ultra-Turrax® mixer, afterwards adding the required amount of cellulose and forming a suspension containing both the cellulose and the hectorite clay, and forming a solution from said suspension by methods well-known per se.

The cellulosic moulded body according to the invention, especially when being in the form of a fibre, may be present in the form of a blend with other types of fibres, especially inherently flame-resistant fibres such as glass, carbon, polyphenylene benzobisoxazole, polybenzimidazole, poly (p-phenylene benzothiazoles), para-aramids, meta-aramids, fluorocarbons, polyphenylene sulfides, melamines, polyimides. polyamideimides, partially oxidized polyacrylonitrile, pre-oxidized fibres, novoloids, chloropolymeric fibres such as those containing polyvinyl chloride, polyvinylidene homopolymers and copolymers, modacrylics which are vinyl chloride or vinylidene copolymer variants of acrylonitrile fibers, fluoropolymer fibres such as polytetrafluoroethylene or polyvinylidene fluoride, flame retardant viscose rayons such as rayon fibres containing a phosphorus compound, silica or alumosilicate modified silica.

Furthermore, a cellulosic fibre according to the invention may be present in a blend with natural fibres such as cotton, flax, hemp, kenaf, ramie, wood pulp, wool, silk, mohair or cashmere or with man-made-fibres such as viscose rayon, polynosic rayon, cuprammonium rayon, lyocell, cellulose esters such as cellulose acetate, polyamides such as nylon 6, nylon 6,6, nylon 11, polyesters such as polyethylene terephthalate, polypropylene terephthalate, polybutylene terephthalate, polytetramethylene terephthalate, copolyesters, polyurethane fibres, polyvinyl alcohol fibres, polyolefins such as polypropylene or polyethylene, polylactides, acrylics and bicomponent fibres.

The fibres which are used to be blended with the cellulosic fibre according to the invention may have been rendered flame retardant by the application of flame retardant chemicals. Flame retardant agents which can be utilized in accordance with embodiments of the present invention include, but are not limited to borates such as boric acid, zinc borate or borax, sulfamates, phosphates such as ammonium polyphosphate, organic phosphorous compounds, halogenated compounds such as ammonium bromide, decabromodiphenyl oxide, or chlorinated paraffin, inorganic hydroxides such as aluminum or magnesium hydroxide, antimony compounds, nitrogen compounds and silica or silicates.

Furthermore, fibres which have been treated with an intumescent compound such as melamine, pentaerythritol, fluorocarbon, graphite, phosphated melamine, borated melamine, sugars, and polyols, may be blended with the fibre according to the present invention.

The fibre according to the present invention may be present in a blend containing only one, or several of the above-listed fibre types.

The present invention also relates to a textile assembly containing a cellulosic fiber according to the present invention.

The textile assembly according to the invention may be present in the form of a woven or nonwoven article.

The nonwoven article maybe formed by way of a method selected from the group consisting of dry-laying, air-laying and wet-laying.

Furthermore, the nonwoven article may be bonded by way of a method selected from the group consisting of thermal bonding, needle-punching, hydroentanglement and chemical bonding.

In the textile assembly according to the present invention, the cellulosic fiber may be present in a mixture with another fiber material, as mentioned above.

In an especially preferred embodiment, the textile assembly according to the invention is characterized in that the cellulosic fiber is present in a mixture with polyester fiber, wherein the ratio of cellulosic fiber to polyester fiber in the mixture is from 1:9 to 9:1, preferably 3:7 to 7:3.

It can be shown that a fibre blend containing only about 30% of a cellulosic fibre according to the present invention and about 70% of non-modified polyester fibre, shows significantly improved resistance to ignition and a lower rate of burning as compared with 100% polyester fibre.

The cellulosic moulded body and the textile assembly according to the present invention have improved flame-retardant properties, such as resistance against ignition.

Hence, the cellulosic moulded body according to the present invention, especially in the form of a Lyocell staple fibre, and/or the textile assembly of the present invention, are useful as flame-retardant articles, i.e. in applications where improved flame-retardant properties are required.

Preferable applications of the cellulosic moulded body and/or the textile assembly according to the invention include the use as a component of articles of furniture (including upholstered sleep products such as mattresses, futons, and mattress foundations), barrier layers in furniture (including barrier layers between the exterior fabric and the inner stuffing of mattresses and upholstered chaits, mattress covers, mattress pads, fiber batting and casing material), top-of-the-bed-products (such as sleeping pads, comforters, duvets, pillows, bedspreads, quilts and fibre fill), panel fabric furniture, wall panels, backing for curtains and rugs, curtains, drapes, floor coverings, tiles, protective apparel, automotive trim surface materials, carpets, transportation seating, textile and nonwoven products in electronic devices (e.g. felts below keypads), bedsheets, fitted sheets, bedcovers, bedlinen, towels, blankets in airplanes, apparel (such as T-shirts, underwear, outerwear, trousers, shirts, socks), wall paper, workwear, insulation material, such as for industrial insulation, automotive insulation and housing insulation, noise insulation materials for household devices, fabrics for decoration, noise dampening for floorings, night wear with reduced flammability, electrical papers, such as electrical papers for insulations, capacitors and transformers, flock, filters, such as air filters, oil filters and fuel filters, military uniforms and clothing, tents, awnings, children's wear, medical drapes and gowns, lightweight fabrics, oil rig and similar clothing, lamp shades, and/or as reinforcement fibers, such as in plastic materials, e.g. in polypropylene.

In the following, the present invention is described in more detail by way of examples of preferred embodiments of the invention.

EXAMPLES

Production Example 1

Discontinuous Production

Synthetic hectorite, type "Optigel SH" (Messrs. Südchemie) was used in this example. This is a hectorite clay which has not been modified.

A dispersion containing 3.6% by weight of the hectorite clay in 78% aqueous NMMO was produced in a high-shear mixer (Ultra-Turrax® Type T50, Messrs. IKA Maschinenbau, Janke & Kunkel, DE) by mixing the components for 1 hour at 8000 rpm.

Cellulose pulp (Type "Bahia", SCAN-viscosity 400) was added to this dispersion in a mixer. The mixture was stirred at 80° C. for one hour. After that, water was distilled off at 95° C. in order to produce a spinning dope containing 13% cellulose, 3% hectorite clay, 11% water and 76% NMMO.

The spinning dope, after having been filtered, was spun into fibres via a jet-wet-spinning process known as such, employing a spinneret with 247 holes of 160 μm diameter each, with an output of 0.045 g dope per spinning hole per minute, an air gap of 20 mm length and a precipitation bath containing 25% aqueous NMMO. The denier of the fibres was 6.7 dtex.

Production Example 2

Continuous Production at a Semi-Commercial Plant

A dispersion containing 4% unmodified hectorite clay (type "Optigel SH") in 78% aqueous NMMO was manufactured in a similar manner as described in example 1, using an Ultra-Turrax® high shear mixer, Type T115KT of Messrs. IKA Maschinenbau, Janke & Kunkel.

In a continuous process, cellulose pulp (Type "Bahia", SCAN-viscosity 400) was added to this dispersion. The suspension thus obtained was converted into a solution in a thin-film treatment apparatus according to the process disclosed in EP 0 356 419 A. The resulting solution was composed of 12.0% cellulose, 2.56% Optigel SH, 11.84% water and 73.6% NMMO. The spinning dope was filtered and spun via a jet-wet-process to fibres.

Three different types of fibres were produced, the first type having a titre of 6.7 dtex and a cutting length of 60 mm, the second type having a titre of 3.3 dtex and a cutting length of 51 mm, and the third type having a denier of 1.3 dtex and a cutting length of 38 mm.

Test Methods:

To assess the flammability performance of the fibre samples, a test method was devised in which the fibre is formed into a sheet and exposed to a small flame.

In this test, by means of a rotor-ring-device, type "3 USTER UDTA 3" (Messrs. Hollingworth) a card sliver is produced. In a laboratory press, a 5 mm short cut is produced. 7 g of this short cut are dispersed by means of a laboratory desintegrator according to ISO 5263 in 2 L of water, employing 3000 rotations of the stirrer. The fibre suspension is filled into the cylinder of a sheet forming apparatus of the "Rapid-Kö then" type according to ISO 5269/2 and DIN 54358, respectively (manufactured by Messrs. Paper Testing Instruments GmbH) and, according to an automated program, a sheet of 200 g/m$^2$ is produced. The sheet is dried at 92° C. for 20 minutes and conditioned.

In order to carry out a test for flame resistance, this cellulose sheet is fixed in a vertically arranged round steel frame with an inner diameter of 150 mm. A small gas flame (vertical size 4 cm, gas consisting of 3.4% propane, 49.4% butane, 17% acetone, 1.5% methyl-acetylene, 27.7% propene and 1% propadiene) is moved horizontally towards the sheet, whereby the vertical distance to the lower inner edge of the steel frame is 2 cm and the horizontal distance to the sheet is 1 cm.

The action of the flame is maintained for 5 minutes. The behaviour of the sheet towards the action of the flame is observed (i.e. whether the flame breaks through the sheet or the material is only partly or fully charred and forms a barrier). If the sheet is charred, the size of the charred area and its robustness (i.e. whether the sheet is destroyed upon touching or maintains a certain amount of residual tenacity) are observed. A larger charred area means that the sheet has suffered greater damage due to the sustained combustion. A charred area which is fragile and easily broken when touched would offer less protection to underlying materials.

In the following tables, Lyocell staple fibres according to the invention and produced according to examples 1 and 2, respectively, were compared with

- standard Lyocell staple fibres (containing no modifying agent),
- Lyocell staple fibres containing other materials, such as kaolin, talkum, and two different hydrophobically modified montmorillonite clays, and
- a commercially available flame-retardant viscose fibre (Type "VISCOSE FR").

The materials underlying Test Examples 1 to 6 of the table were produced by applying the conditions set out in Production Example 1.

The materials underlying Test Examples 9 to 11 of the table were produced by applying the conditions set out in Production Example 2.

TABLE

| Test Example | Fibre Type | Additive | Manufacturer | Type of additive | Denier of fibre (dtex) | Amount of additive (% by weight of cellulose) | Flame break through time(s)* | Portion of charred area (%) | Robustness of charred area |
|---|---|---|---|---|---|---|---|---|---|
| 1 | Lyocell | Laponite RD | Rockwood Additives | Unmodified Hectorite | 6.7 | 23.0 | >300 | 30.3 | flexible, is not destroyed upon touching |
| 2 | Lyocell | Optigel SH | Südchemie | Unmodified Hectorite | 6.7 | 23.0 | >300 | 38.4 | flexible, is not destroyed upon touching |
| 3 (C) | Lyocell | Ultragloss 90 | Engelhard | Kaolin | 6.7 | 23.0 | >300 | 71.8 | is destroyed upon touching |
| 4 (C) | Lyocell | Talkum A 7 | Naintsch | Talkum | 6.7 | 23.0 | ~60 | 70.8 | is destroyed upon touching |
| 5 (C) | Lyocell | Nanofil - 9 | Südchemie | Montmorillonite, modified with benzylmethyl distearylammonium salt | 6.7 | 23.0 | >300 | 76.9 | flexible, is not destroyed upon touching |

TABLE-continued

| Test Example | Fibre Type | Additive | Manufacturer | Type of additive | Denier of fibre (dtex) | Amount of additive (% by weight of cellulose) | Flame break through time(s)* | Portion of charred area (%) | Robustness of charred area |
|---|---|---|---|---|---|---|---|---|---|
| 6 (C) | Lyocell | Nanofil - 8 | Süd-chemie | Mont-morillonite, modified with dimethyldi-stearyl-ammonium salt | 6.7 | 23.0 | >300 | 100 | destroyed |
| 7 (C) | Lenzing Viskos FR ® | | | | 5.5 | | ~70 | 33 | Minor damage |
| 8 (C) | Lyocell | none - | | — | 6.7 | | burns com-pletely | | |
| 9 | Lyocell | Optigel SH | Süd-chemie | Unmodified Hectorite | 6.7 | 21.3 | >300 | 31.3 | flexible, is not destroyed upon touching |
| 10 | Lyocell | Optigel SH | Süd-chemie | Unmodified Hectorite | 3.3 | 21.3 | >300 | 45.5 | flexible, is not destroyed upon touching |
| 11 | Lyocell | Optigel SH | Süd-chemie | Unmodified Hectorite | 1.3 | 21.3 | ~70 | 47.2 | flexible, is not destroyed upon touching |

*A flame break-through time of >300 s means that the test was stopped after 300 s without the flame having broken through the cellulose sheet.

As apparent from the above table, the Lyocell fibres according to the present invention are clearly superior to the other Lyocell fibres according to the comparison examples (marked with (C)) and comparable to the well-established commercially available Lenzing Viscose FR®-fibre. Especially, if compared with the Lyocell fibres containing modified montmorillonite, it can be seen that the portion of charred area of the montmorillonite-containing fibres is much higher than that of the fibres according to the invention.

Figure 2:
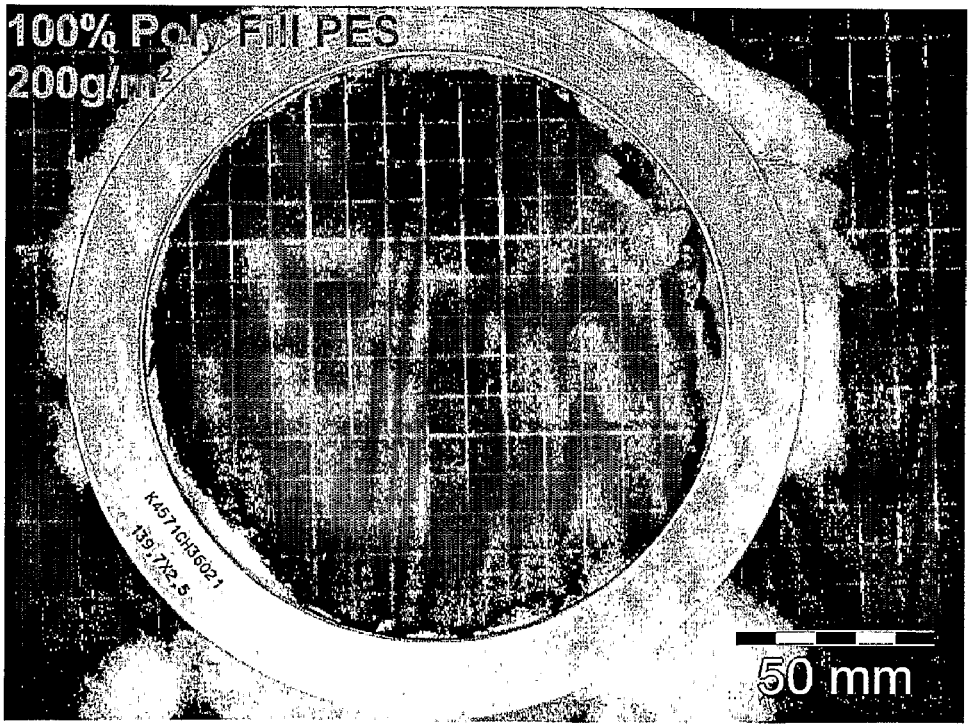

FIGS. 1 and 2, respectively, show the results of the above-described test with a fiber sheet made of 33% Lyocell fiber containing Optigel®g SH hectorite clay and 67% polyester fiber (FIG. 1) and a fiber sheet made of 100% polyester fiber.

It is clearly apparent from the figures, that the mixture of the fiber according to the invention and polyester fiber is only partly charred (cf. the black area in FIG. 1), whereas a sheet made from 100% polyester fiber is completely burned down.

This means that even if the fiber according to the invention is admixed in only small portions to other fiber types, excellent resistance against the action of a flame can be achieved.

The response to flame contact of the fibre according to example 9 of the above table was, furthermore, determined additionally according to DIN 54 336 (Vertical method, edge ignition).

The fibre was tested in the form of a lightly needled non-woven:

| Area Weight ($g/m^2$) | Length of destroyed area (mm) | Velocity of flame spreading (mm/s) | Remarks |
|---|---|---|---|
| 50 | 430 | 53 | |
| 100 | 430 | 10 | |
| 200 | 30 | — | Flame extinguishes after 13 s |

What is claimed is:

1. A cellulosic molded body produced from a solution of cellulose in an aqueous tertiary amine-oxide, wherein said molded body comprises a cellulose/clay nanocomposite and wherein the clay component of said nanocomposite comprises a material selected from the group consisting of unmodified hectorite clays and hydrophilically modified hectorite clays.

2. The cellulosic molded body according to claim 1, wherein the clay component ranges from 5 to 40% by weight of the molded body.

3. The cellulosic molded body according to claim 1, wherein the molded body is selected from the group consisting of a filament fiber, a staple fiber, a film and a membrane.

4. A process for the manufacturing of a cellulosic molded body according to claim 1, 2 or 3, comprising the steps of:

(a) providing cellulose;

(b) preparing a mixture of said cellulose with an aqueous tertiary amine-oxide;

(c) converting said mixture into a solution of cellulose in the aqueous tertiary amine-oxide;

(d) molding said solution via a molding tool; and (e) precipitating said solution in a precipitating fluid, wherein at least one of steps a) to c) is carried out in the presence of a material selected from the group consisting of unmodified hectorite clays and hydrophilically modified hectorite clays.

5. The process according to claim 4, wherein step b) comprises preparing a suspension of the clay in the aqueous tertiary amine-oxide and wherein the cellulose is added to said suspension.

6. The process according to claim 5, wherein the clay is dispersed in said aqueous tertiary amine-oxide by applying high shear forces.

7. The process according to claim 6, wherein the portion of the clay in said dispersion is from 1 to 4% by weight of dispersion.

8. A textile assembly containing a cellulosic molded body according to claim 1, 2 or 3.

9. The textile assembly according to claim 8 having the form of a woven or nonwoven article.

10. The textile assembly according to claim 8, wherein the cellulosic molded body is present in a mixture with a fiber material.

11. The textile assembly according to claim 10, wherein the fiber material is a polyester fiber, and wherein the ratio of cellulosic molded body to polyester fiber in the mixture is from 1:9 to 9:1.

12. The textile assembly according to claim 11, wherein the fiber material is a polyester fiber, and wherein the ratio of cellulosic molded body to polyester fiber in the mixture is from 3:7 to 7:3.

13. The cellulosic molded body according to claims 1, 2 or 3, for use as a flame-retardant article.

14. The textile assembly according to claim 8, for use as a flame retardant article.

15. The cellulosic molded body according to claims 1, 2 or 3, for use as a component of articles selected from the group consisting of furniture, barrier layers in furniture, top-of-the-bed-products, panel fabric furniture, wall panels, backing for curtains and rugs, curtains, drapes, floor coverings, tiles, protective apparel, automotive trim surface materials, carpets, transportation seating, textile and nonwoven products in electronic devices, bedsheets, fitted sheets, bedcovers, bedlinen, towels, blankets in airplanes, apparel, wall paper, workwear, insulation material, fabrics for decoration, noise dampening for floorings, night wear with reduced flammability, electrical papers, flock, filter, tents, awnings, lightweight fabrics, lamp shades, and as reinforcement fibers.

16. The textile assembly according to claim 8, for use as a component of articles selected from the group consisting of furniture, barrier layers in furniture, top-of-the-bed-products, panel fabric furniture, wall panels, backing for curtains and rugs, curtains, drapes, floor coverings, tiles, protective apparel, automotive trim surface materials, carpets, transportation seating, textile and nonwoven products in electronic devices, bedsheets, fitted sheets, bedcovers, bedlinen, towels, blankets in airplanes, apparel, wall paper, workwear, insulation material, fabrics for decoration, noise dampening for floorings, night wear with reduced flammability, electrical papers, flock, filter, tents, awnings, lightweight fabrics, lamp shades, and as reinforcement fibers.

17. The cellulosic molded body according to claim 15, wherein the furniture is selected from the group consisting of upholstered sleep products, mattresses, futons, and mattress foundations.

18. The cellulosic molded body according to claim 15, wherein the barrier layers in furniture are selected from the group consisting of barrier layers between the exterior fabric and the inner stuffing of mattresses, upholstered chairs, mattress covers, mattress pads, fiber batting and casing material.

19. The cellulosic molded body according to claim 15, wherein the top-of-the-bed products are selected from the group consisting of sleeping pads, comforters, duvets, pillows, bedspreads, quilts and fiber fill.

20. The cellulosic molded body according to claim 15, wherein the nonwoven products in electronic devices are felts below keypads.

21. The cellulosic molded body according to claim 15, wherein the apparel are selected from the group consisting of T-shirts, underwear, outerwear, trousers, shirts, socks, military uniforms and clothing, children's wear, medical drapes and gowns, and oil rig clothing.

22. The cellulosic molded body according to claim 15, wherein the insulation material is selected from the group consisting of industrial insulation, automotive insulation, housing insulation, and noise insulation materials for household devices.

23. The cellulosic molded body according to claim 15, wherein the reinforcement fibers are reinforcement fibers used in plastic materials.

24. The textile assembly according to claim 16, wherein the furniture is selected from the group consisting of upholstered sleep products, mattresses, futons, and mattress foundations.

25. The textile assembly according to claim 16, wherein the barrier layers in furniture are selected from the group consisting of barrier layers between the exterior fabric and the inner stuffing of mattresses, upholstered chairs, mattress covers, mattress pads, fiber batting and casing material.

26. The textile assembly according to claim 16, wherein the top-of-the-bed products are selected from the group consisting of sleeping pads, comforters, duvets, pillows, bedspreads, quilts and fiber fill.

27. The textile assembly according to claim 16, wherein the nonwoven products in electronic devices are felts below keypads.

28. The textile assembly according to claim 16, wherein the apparel are selected from the group consisting of T-shirts, underwear, outerwear, trousers, shirts, socks, military uniforms and clothing, children's wear, medical drapes and gowns, and oil rig and similar clothing.

29. The textile assembly according to claim 16, wherein the insulation material is selected from the group consisting of industrial insulation, automotive insulation and housing insulation and noise insulation materials for household devices.

30. The textile assembly according to claim 16, wherein the reinforcement fibers are reinforcement fibers used in plastic materials.

31. The cellulosic molded body according to claim 15, wherein the electrical papers are electrical papers for insulations.

32. The cellulosic molded body according to claim 15, wherein the filters are selected from the group consisting of air filters, oil filters and fuel filters.

33. The cellulosic molded body according to claim 23, wherein the plastic material is polypropylene.

34. The textile assembly according to claim 16, wherein the electrical papers are electrical papers for insulations.

35. The textile assembly according to claim 16, wherein the filters are selected from the group consisting of air filters, oil filters and fuel filters.

36. The textile assembly according to claim 30, wherein the plastic material is polypropylene.

* * * * *